US006244028B1

(12) United States Patent
Kross

(10) Patent No.: US 6,244,028 B1
(45) Date of Patent: Jun. 12, 2001

(54) SPINDLE

(75) Inventor: Stefan Kross, Viersen (DE)

(73) Assignee: Volkmann GmbH & Co. (DE)

( * ) Notice: Subject to any disclaimer, the term of this patent is extended or adjusted under 35 U.S.C. 154(b) by 0 days.

(21) Appl. No.: 09/292,926

(22) Filed: Apr. 16, 1999

(30) Foreign Application Priority Data

Apr. 18, 1998 (DE) ..... 198 17 315
Apr. 18, 1998 (DE) ..... 198 17 314

(51) Int. Cl.[7] ..... D01H 1/10
(52) U.S. Cl. ..... 57/58.49; 57/58.52; 57/58.65
(58) Field of Search ..... 57/58.49, 58.52, 57/58.54, 58.65, 58.67, 58.7, 400, 404

(56) References Cited

U.S. PATENT DOCUMENTS 2,537,506 * 1/1951 Beria ..... 57/58.7
3,368,336 * 2/1968 Franzen ..... 57/58.67
3,406,511 * 10/1968 Nimtz et al. ..... 57/58.65
5,085,045 * 2/1992 Takeuchi et al. ..... 57/58.65

* cited by examiner

*Primary Examiner*—John J. Calvert
*Assistant Examiner*—Gary L. Welch
(74) *Attorney, Agent, or Firm*—Robert W. Becker & Associates

(57) ABSTRACT

In order to be able to operate a spindle as a multi twisting spindle as well as a doubling spindle or a bobbin peg, the spindle has a rotatably driven spindle shaft; a twisting pot rotatably driven by the spindle shaft and having a bottom with a radially extending yarn guide channel; a rotatingly driven spool carrier for receiving a spool; a hollow spindle axle centrally guided through the spool carrier and connected to the yarn guide channel; and a centering eye arranged on an extension of the hollow spindle axle. A placement member is introduced into the spool carrier and vertically reciprocated for placement especially of a doubled yarn onto the spool rotating together with the driven spool carrier.

16 Claims, 6 Drawing Sheets

SPINDLE

BACKGROUND OF THE INVENTION

The invention relates to a spindle having a rotatorily driven spindle shaft; a twisting pot driven in rotation by the spindle shaft and having at its bottom a radially extending yarn guide channel; a rotatorily driven spool carrier for receiving a spool; a hollow axle centrally extending through the spool carrier and connected to the yarn guide channel; and a centering eye arranged on an extension of the hollow spindle axle.

The invention has the object to design a spindle such that it can be used either as a twisting spindle, especially a multi twisting spindle in the form of a two-for-one twisting spindle or a three-for-one twisting spindle, or a doubling spindle or a bobbin peg.

SUMMARY OF THE INVENTION

As a solution to this object the inventive spindle is characterized in that a placing member that can be introduced into the spool carrier and can be vertically reciprocated is provided for placing especially a doubled yarn removed from a bobbin creel onto a spool that is rotating on the driven spool carrier.

When it is desired to operate the spindle as a two-for-one twisting spindle, the spool carrier is secured in a conventional manner, for example, by a switchable solenoid coupling, against rotation.

In the case that the spindle is to be operated as a three-for-one twisting spindle, the spool carrier and the twisting pot are preferably rotated in opposite directions. For operation as a doubling spindle or bobbin peg, it is possible to eliminate the drive action of the twisting pot in order to save energy.

BRIEF DESCRIPTION OF THE DRAWINGS

The invention will be described in detail with the aid of the drawings.

DESCRIPTION OF PREFERRED EMBODIMENTS

Figure 1:
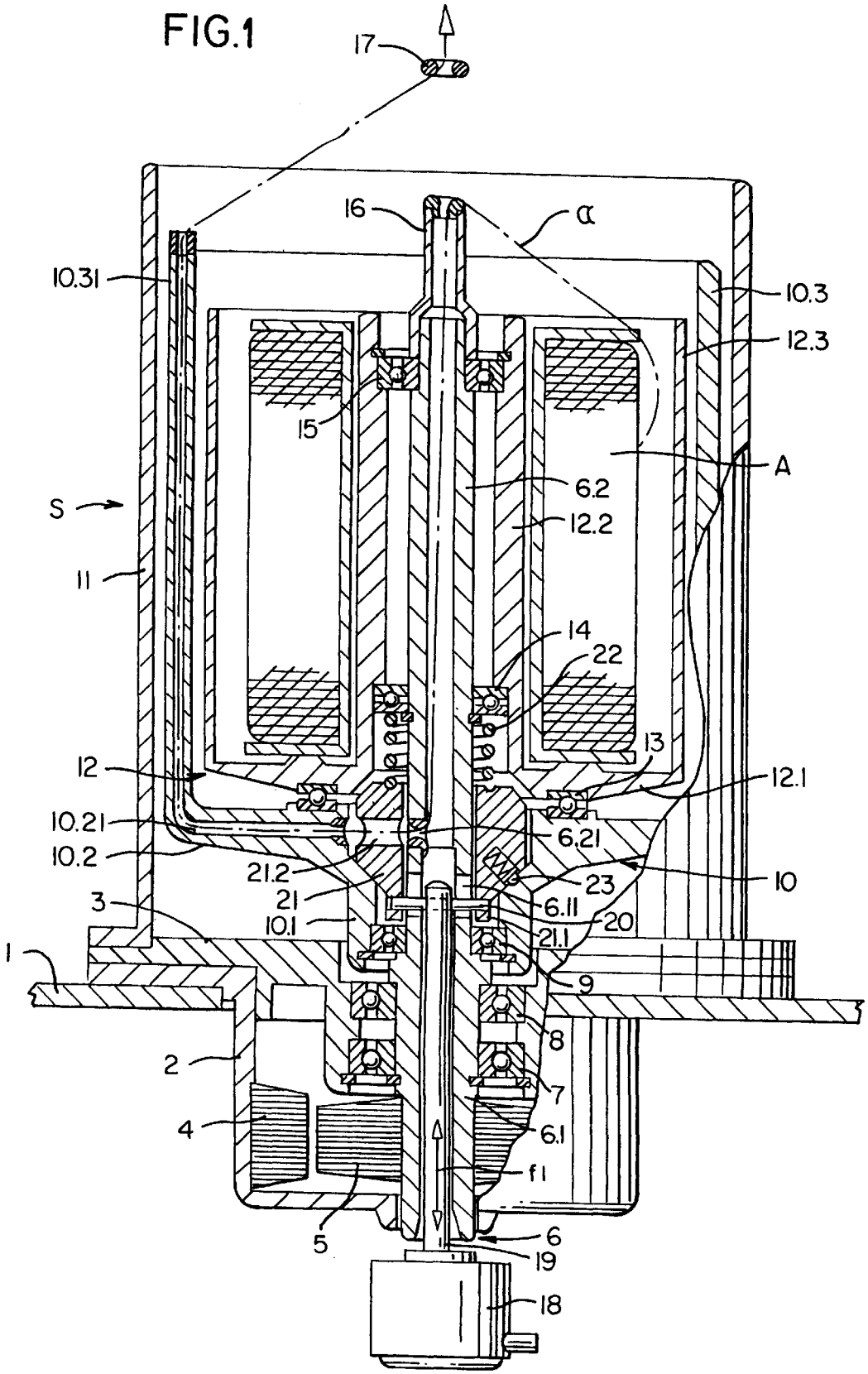
FIG. 1 shows in axial section a two-for-one twisting spindle.

FIG. 1 shows a portion of a machine frame 1 with drive and bearing housing 2 and bearing housing cover 3 for supporting a two-for-one twisting spindle. An electric motor for driving a hollow spindle 6 is arranged in the bearing housing 2 and is comprised of a stator 4 and a rotor 5. The lower portion 6.1 of the hollow spindle 6 functions as a conventional spindle shaft and the upper portion 6.2 has the function of a conventional hollow spindle shaft of a two-for-one twisting spindle.

The spindle shaft section 6.1 of the hollow shaft 6 is supported in a manner, that is not part of the present invention, by bearings 7 and 8 in a bearing hub of the bearing housing cover 3.

On the lower section of the hollow shaft 6, which forms the spindle shaft 6.2, a twisting pot 10 is supported by a bearing 9. It is comprised of a bearing hub 10.1, a twisting pot bottom 10.2, and a twisting pot mantle 10.3 which is surrounded by the spindle housing 11.

The spool carrier 12, comprised of a spool carrier bottom 12.1, a spool carrier hub 12.2, and a spool carrier protective pot 12.3, is supported, on the one hand, by its spool carrier bottom 12.1 with interposition of an axial bearing 13 on the upper side of the twisting pot bottom 10.2, and, on the other hand, by the spool carrier hub 12.2 with interposition of a radial bearing 15 at the upper section of the hollow shaft 6 that forms the hollow spindle axle 6.2. The yarn inlet tube 16 is placed onto the upper end of the hollow spindle axle 6.2 and in its axial extension a conventional centering eye 17 of a two-for-one twisting spindle is positioned.

The hollow spindle axle 6.2 is provided with a radial opening 6.21 at its lower portion which is positioned opposite a yarn guide channel 10.21 extending radially through the twisting pot bottom 10.2. A yarn guide channel 10.31 is connected thereto and extends in the axial direction through the twisting pot mantle 10.3.

Through the hollow spindle shaft 6.1 the lifting rod 19 is guided which is adjustable by a lifting member 18 in the direction of double arrow f1 and has at its upper end two radially outwardly oriented follower pins 20 which engage radially outwardly through axial slots 6.11 the collar projection 21.1 of a coupling member 21. This coupling member 21 is provided with a radial opening 21.2 which, in the position represented in FIG. 1, provides the connection between the radial openings 6.21 of the hollow spindle axle 6.2 and the yarn guide channel 10.21 of the twisting pot bottom 10.2.

In FIG. 1 the coupling member 21 is positioned with its preferably conically designed coupling surface at a counter coupling surface of the bearing bushing 10.1 of the twisting pot whereby the pressure force between the coupling member and the bearing bushing 10.1 is enhanced, respectively, is increased by a pressure spring 22 supported at the bearing 14. The spring 22 rests at the upper side of the coupling member. The lifting rod 19 is then positioned in the lower position. The aligned position between the radial opening 6.21 of the hollow spindle axle, of the radial opening 21.2 of the coupling member, and the yarn guide channel 10.21 of the twisting pot is ensured by a catch element 23.

In order to prevent during the process of two-for-one twisting that the spool carrier 12 rotates when the spindle shaft 6.1 and the twisting pot 10 rotate, it is possible to provide non-represented securing elements, preferably a switchable solenoid coupling, for securing the spool carrier in a non-rotating position.

Figure 4:
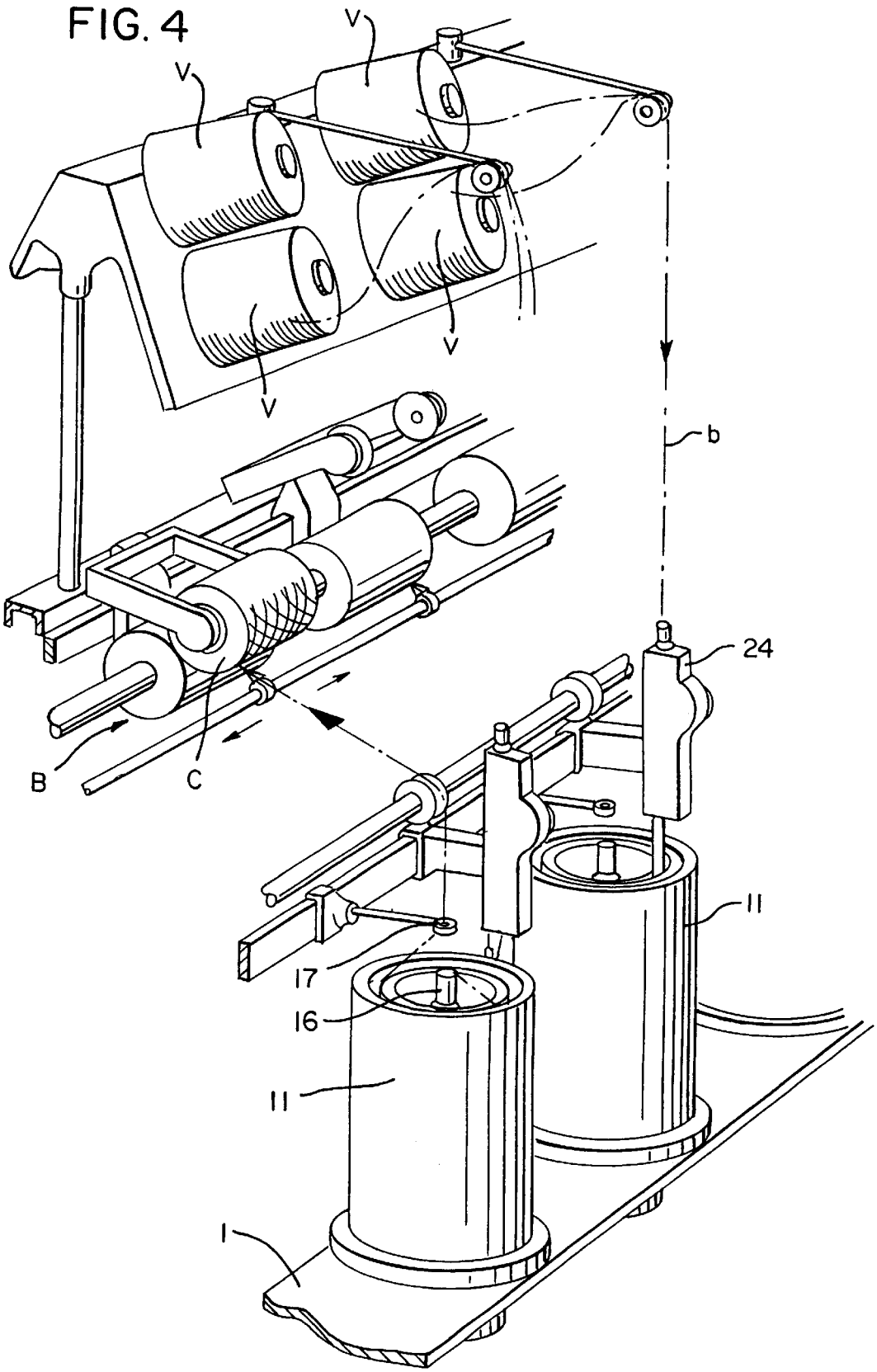
FIG. 4 shows partly in isometric representation the two-for-one twisting machine with a spindle operating according to the two-for-one principle and a spindle operating as a doubling spindle or bobbin peg.

In order to employ the spindle represented in FIG. 1 as a two-for-one twisting spindle, the supply bobbin A placed onto the spool carrier 12, that is secured against rotation, has a yarn "a" removed therefrom through the yarn inlet tube 16, the hollow spindle axle 6.2, the radial openings 6.21 and 21.2, the yarn guide channel 10.21 as well as the axially extending yarn guide channel 10.31 and the centering eye 17. Subsequently, the yarn a is then moved to a yarn winding device B schematically represented in FIG. 4 in order to be wound as a cross bobbin C.

Figure 2:
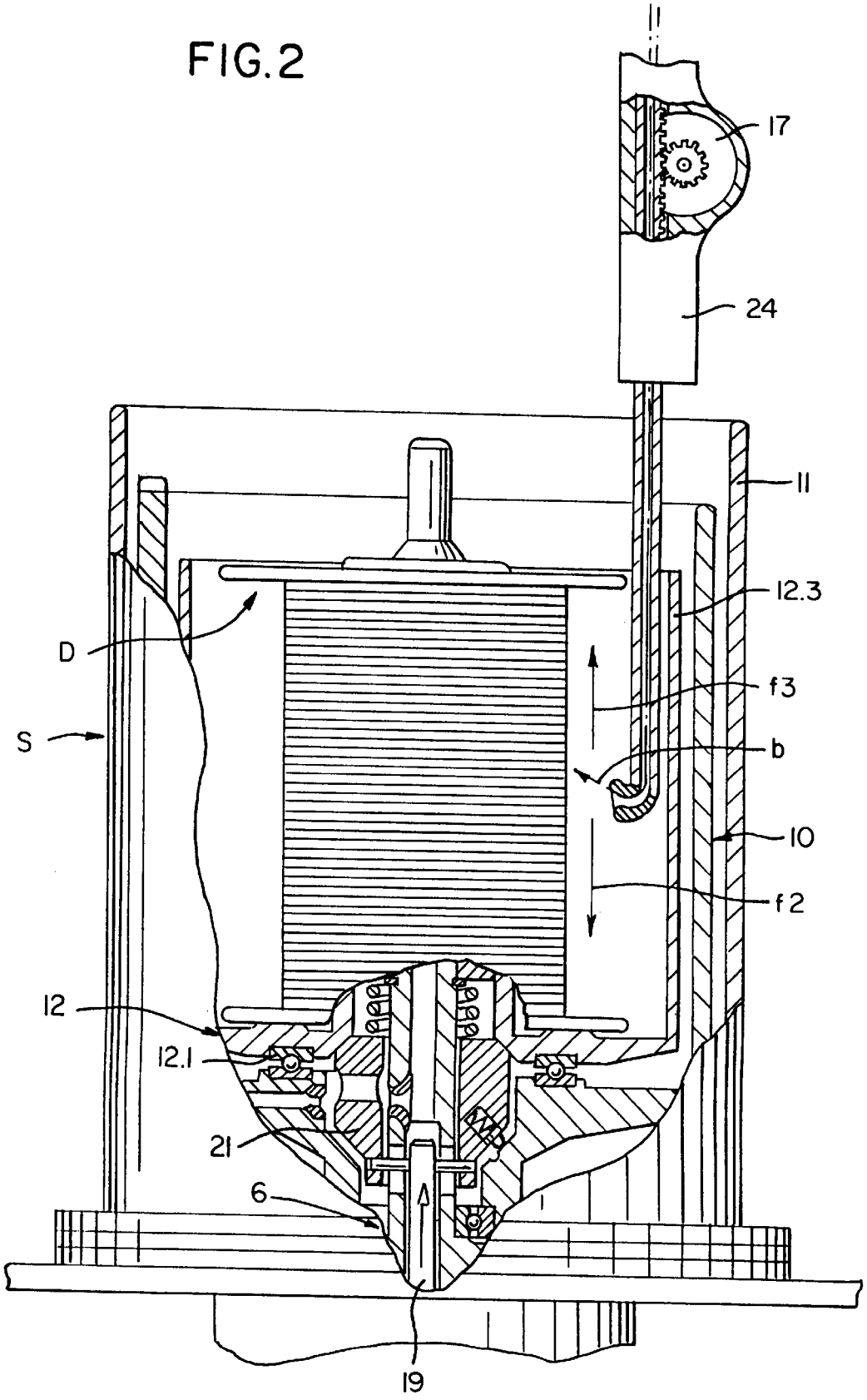
FIG. 2 shows partly in axial section the spindle according to FIG. 1 operating as a doubling spindle or bobbin peg.

In order to employ the spindle according to FIG. 2 as a doubling spindle or bobbin peg, the upward movement of the lifting rod 19 pushes the coupling member with its upper, preferably conically shaped, coupling surface against the counter coupling surface of the spool carrier bottom 12.1 so that now the spool carrier 12 is rotated together with the rotating hollow shaft 6.

A doubling spool is placed onto the spool carrier 12; in the shown case it is a disc-shaped spool D.

In FIG. 2 a positioning head 24 is positioned above the spindle housing 11. It moves a positioning tube 26, for example, by a pinion drive 25, into the spool carrier protective pot 12.3 and also vertically reciprocates it in the direction of arrows f2, f3 in order to place a doubled yarn "b" removed from supply bobbins V of the bobbin creel (FIG. 4), onto the doubling spool while the doubling spool D rotates.

The invention thus makes it possible to employ one and the same spindle, for example, in a first operation for winding a doubled spool and, subsequently, in a second operation, in the manner represented in FIG. 1, for removing the doubled yarn from the supply bobbin A and to twist it according to the two-for-one principle and to wind it as a twisted yarn spool C.

Figure 3:
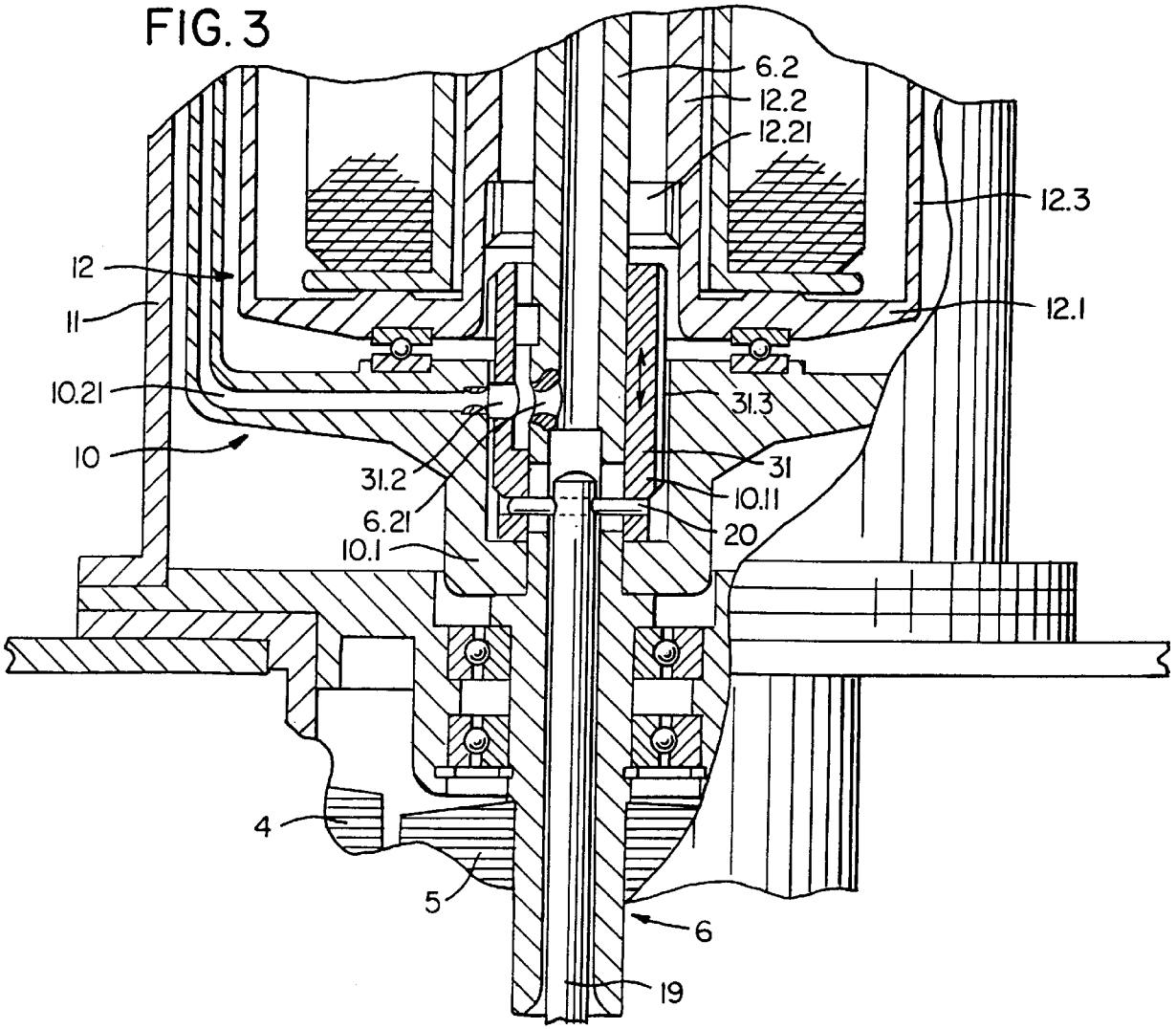
FIG. 3 shows partly in axial section a differently designed embodiment of the spindle.

The embodiment according to FIG. 3 differs from the embodiment according to FIGS. 1 and 2 in that the coupling is formed as a coupling slide bushing 31 that is provided with a radial yarn channel 31.2 can be displaced along the hollow shaft 6, which is provided at its outer circumference with a toothing 31.3. The twisting pot hub 10.1 is provided with an inner toothing 10.11 cooperating with the outer toothing 31.3. The spool carrier hub 12.2 is also provided with an inner toothing 12.21 cooperating with the outer toothing 31.3 of the slide bushing 31.

The individual outer and inner toothings can be adjusted in their axial position such that the following operational states are possible.

1. The slide bushing 31 is lowered to such an extent that the inner toothing 12.21 is positioned outside of the range of the outer toothing 31.3 so that, when the spindle shaft 6.1 rotates, only the twisting pot 10 is rotated so that operation is according to the two-for-one principle.
2. With the slide bushing 31 in the uppermost position, the twisting pot 10 as well as the spool carrier 12 are rotated by engagement of the outer toothing 31.3 in the inner toothings 10.11 and 12.21 whereby then the twisting pot 10, which also rotates but performs no function, produces a doubled spool according to FIG. 2.
3. With the slide bushing 31 being in the uppermost position only the spool carrier 12 is rotated so that then an operational state comparable to that of FIG. 2 is achieved.

Figure 5:
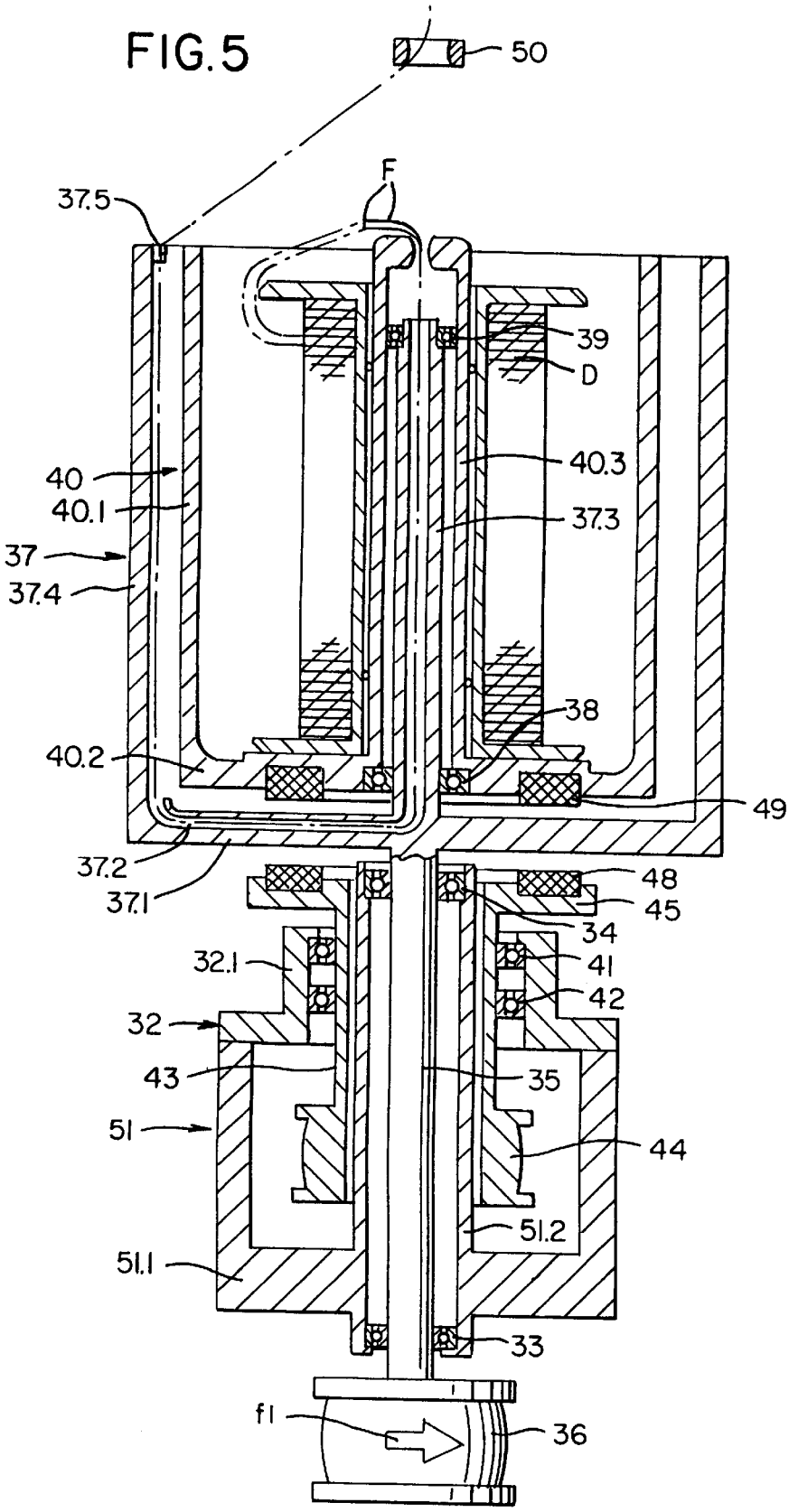
FIG. 5 shows in axial section a spindle which is embodied as a twisting spindle with a three fold twisting action.

FIG. 5 shows a bearing and drive housing 51 with a bottom 51.1 and a central bearing hub 51.2 connected to the bottom. A housing cover 32 is provided at the upper side of the housing 51 and has a further bearing hub 32.1.

The spindle shaft 35 is rotatably supported in the bearing hub 51.2 by bearings 33 and 34 and has at its lower end a spindle whorl 36 that is rotatably driven in the direction of arrow F1. The spindle shaft supports at its upper end the twisting part 37 having at its bottom 37.1 a radially extending yarn guide channel 37.2. Connected to the inner end of the yarn guide channel 37.2 is a hollow spindle axle 37.3 positioned on the extension of the spindle shaft 35 whereby, according to FIG. 5, the spindle axle 37.3 is a unitary part of the twisting pot 37 (this is only an exemplary embodiment).

A spool carrier 40, comprising of spool carrier protective pot 40.1 as well as of spool carrier bottom 40.2, is rotatably supported by a spool carrier hub 40.3 connected to the spool carrier bottom 40.2 by bearings 38 and 39 on the hollow spindle axle 37.3.

The spool carrier 40 serves for receiving and supporting a double spool, respectively, supply spool D which is positioned with its spool sleeve on the spool carrier bottom 40.2

A sleeve 43 is rotatably supported by bearings 41 and 42 in the bearing hub 32.1. Its lower end has a whorl 44 that is rotated preferably counter to the spindle whorl 36 and has at its upper end a flange 45 in which follower magnets 48 are positioned along a circular path. These magnets 48 are positioned opposite counter magnets 49 provided at the spool carrier bottom 40.2 which, relative to the follower magnets 48, are polarized such that for a rotating whorl 44 the spool carrier 40 is also rotated.

For a rotating twisting pot 37 the yarn F is removed from the supply bobbin in the upward direction and guided into the hollow spindle axle 37.3 first downwardly and then through the yarn guide channel 37.2 radially outwardly and then again along the twisting pot mantle 37.4 in an upward direction to the yarn guide eye 50 that is positioned on an extension of the hollow spindle axle. From there the yarn is then guided onto a non-represented winding device. The twisting pot mantle 37.4 is provided at its upper end with a yarn guide eye 37.5 for the purpose of stabilizing the yarn guiding action.

According to the three-for-one twisting principle, the whorl 44 is rotated opposite to the rotational direction of the spindle whorl 36 so that the spool carrier 40 and thus the supply bobbin D are also rotated so that the yarn removed through the yarn guide eye 50 is subjected to triple twisting.

Figure 6:
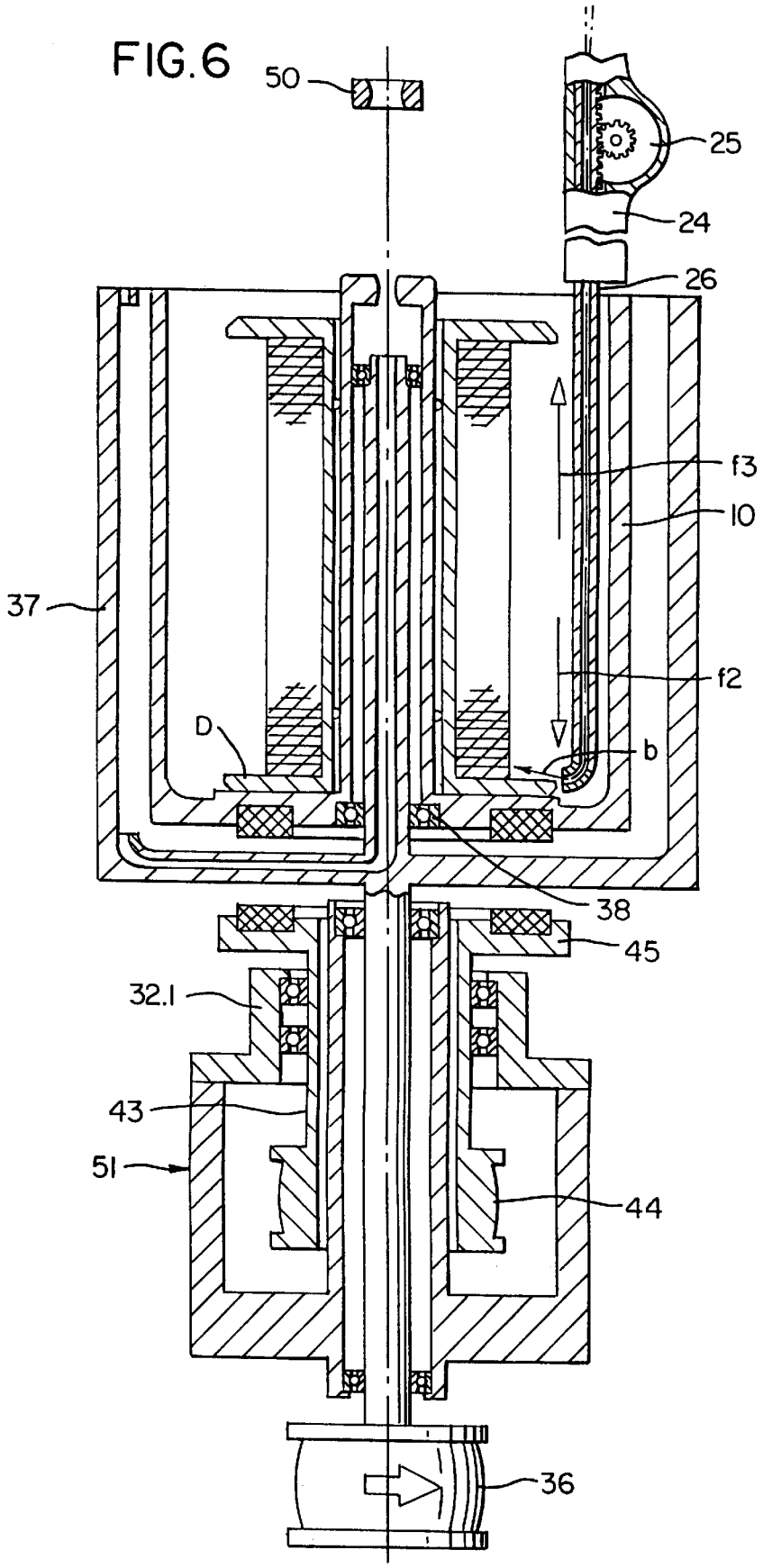
FIG. 6 shows in axial section the same spindle as FIG. 5 but operating as a doubling spindle or bobbin peg.

In FIG. 6, above the twisting pot 37 a placement head 24 is represented at a sufficient spacing above the twisting pot 37. It is designed to introduce, for example, with the aid of a pinion drive 25, a placement tube 26 into the spool carrier 40 and also to vertically and alternatingly reciprocate it in the direction of arrows f2 and f3.

The spool inserted according to FIG. 6 into the spool carrier is a blank doubling spool D onto which, for example, a doubled yarn b removed from a non-represented bobbin creel is to be placed by the vertically reciprocating placement tube 26 when the twisting pot 37 is stationary and the spool carrier 40 rotates.

The invention thus makes it possible to wind on one and the same spindle, for example, in a first step a doubled bobbin and, subsequently, in a second method step, to remove this doubled yarn from the doubled spool or supply spool D in the manner represented in FIG. 6 and to twist it according to the three-for-one principle and to wind it in a conventional manner onto a twisting spool.

The specification incorporates by reference the disclosure of German priority documents 198 17 315.6 of Apr. 18, 1998, and 198 17 314.8 of Apr. 18, 1998.

The present invention is, of course, in no way restricted to the specific disclosure of the specification and drawings, but also encompasses any modifications within the scope of the appended claims.

What is claimed is:

1. A spindle comprising:

a rotatorily drive spindle shaft (6.1; 35);

a twisting pot (10; 37) driven in rotation by said spindle shaft and having a bottom (10.2) with a radially extending yarn guide channel (10.21; 37.2);

a rotatorily driven spool carrier (10;40) for receiving a spool;

a hollow spindle axle (6.2; 37.3) centrally extending through said spool carrier and connected to said yard guide channel;

a centering eye (17; 50) arranged on an extension of said hollow spindle axle, said centering eve (17; 50) followed by a yarn-winding device B;

a placement member that can be introduced into the spool carrier (10; 40) and vertically reciprocated for placement for a doubled yarn onto a spool rotating with said driven spool carrier.

2. A spindle according to claim 1, wherein said spool carrier (12) is arrestable against rotation in the manner of a two-for-one twisting spindle.

3. A spindle according to claim 2, further comprising a coupling cooperating with said spindle shaft (6.1) for selectively driving said spool carrier (12).

4. A spindle according to claim 3, wherein said coupling can be switched between drive positions for simultaneously driving said twisting pot (10) and said spool carrier (12) or driving only said twisting pot (10).

5. A spindle according to claim 3, wherein said coupling is a coupling member (21, 31) fixedly connected to said spindle shaft (6.1), wherein, for driving said spool carrier (12), said coupling member (21, 31) is adjustable in a direction of said spool carrier and has a yarn channel (21.2 or 31.2) connected to said yarn guide channel (10.21).

6. A spindle according to claim 5, further comprising a lifting rod (19) fixedly connected to said coupling member (21, 31) and guided through said spindle shaft (6.1).

7. A spindle according to claim 5, wherein said coupling member (21) has top and bottom sides that are conical coupling surfaces and wherein said twisting pot (10) and said spool carrier (12) are respectively provided with counter coupling surfaces.

8. A spindle according to claim 7, further comprising a catch element (23) acting between said coupling member (21) and said twisting pot (10).

9. A spindle according to claim 8, further comprising a pressure element comprising a pressure spring (22), forcing said coupling member into a lower position.

10. A spindle according to claim 8, wherein:

said coupling member is embodied as a coupling slide bushing (31), connected fixedly to said lifting rod (9) and having at its outer circumference an outer toothing (31.3);

said twisting pot (10) and said spool carrier (12) are embodied with inner toothings (31.3; 21.3), whereby the axial lengths of said inner and outer toothings are matched to one another such that an axial displacement of said coupling slide bushing (31) results in said slide bushing (31) to be coupled either A) only to said twisting pot (10), B) only to said spool carrier (12), C) to said twisting pot (10) as well as to said spool carrier (12).

11. A spindle according to claim 3, wherein said placement member comprises a placement head (24) positioned above said spindle and a placement tube (26), wherein said placement tube (26) is extendable into a spool carrier protective pot (12.3) and vertically reciprocated.

12. A spindle according to claim 1, wherein said spool carrier (12) is supported rotatably on said bottom (10.2) of said twisting pot (10).

13. A spindle according to claim 1, wherein said spool carrier (12), in order to secure it against rotation, has coordinated therewith a switchable solenoid.

14. A spindle according to claim 1, wherein said spool carrier (40) is driven in the manner of a three-for-one twisting spindle especially counter to said twisting pot (37).

15. A spindle according to claim 1, wherein said placement member is introduced when said twisting pot (10) is stationary but said spool carrier (12) rotates.

16. A spindle according to claim 15, wherein said placement member comprises a placement head (24) positioned above said twisting pot (37) and further comprises a placement tube (26) introduced into and vertically reciprocated within said spool carrier (40).

* * * * *